US008449103B2

(12) United States Patent
Crum

(10) Patent No.: US 8,449,103 B2
(45) Date of Patent: May 28, 2013

(54) METHOD AND APPARATUS FOR HIGH-SPEED MULTICOLOR INKJET PRINTING

(75) Inventor: Jesse D. Crum, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 59 days.

(21) Appl. No.: 13/079,648

(22) Filed: Apr. 4, 2011

(65) Prior Publication Data

US 2011/0242167 A1 Oct. 6, 2011

Related U.S. Application Data

(60) Provisional application No. 61/321,336, filed on Apr. 6, 2010.

(51) Int. Cl.
*B41J 2/01* (2006.01)

(52) U.S. Cl.
USPC ..... 347/103

(58) Field of Classification Search
CPC ..... B41M 1/10; C09D 7/1266
USPC ..... 347/9, 101–104
See application file for complete search history.

(56) References Cited

U.S. PATENT DOCUMENTS 6,354,700 B1 * 3/2002 Roth ..... 347/103

* cited by examiner

*Primary Examiner* — An Do
(74) *Attorney, Agent, or Firm* — Lathrop & Gage LLP

(57) ABSTRACT

Versatility and high resolution are imparted to a high-speed printing apparatus by depositing separate colors of inkjet ink, under computer control, directly onto the blanket cylinder(s) for transfer to a printable substrate held on an impression cylinder, thus eliminating the need for printing plates and making it possible to electronically change the image or any part thereof from one impression to the next via a computer program. A plurality of inkjet heads may also successively deposit inks of different consistency directly on one or more blanket rollers under the control of a computer.

8 Claims, 4 Drawing Sheets

METHOD AND APPARATUS FOR HIGH-SPEED MULTICOLOR INKJET PRINTING

RELATED APPLICATION

This application claim priority to U.S. Provisional Patent Application 61/321,336, filed Apr. 6, 2010, the disclosure of which is incorporated herein by reference.

FIELD OF THE INVENTION

This invention relates to high-speed printing on moving substrates, and, in addition, to a method and apparatus for printing short runs and variable images by using inkjet techniques on printers equipped for offset or flexographic printing.

BACKGROUND OF THE INVENTION

Automated high-speed production lines for printing sheets of labels or the like conventionally use offset or flexographic printing equipment in which four rotating printing plates (for the three basic colors plus black) print four images in exact superimposed relationship onto a pair of transfer rollers from which the colored image is then transferred to a substrate (paper, plastic or the like) conveyed through the printer on an impression cylinder.

Although the resolution of this printing process is limited, it is satisfactory for many practical applications in which production speed is important. This is typically the case for orders of millions of identical items such as labels in which set-up time and variability are secondary considerations.

A problem arises when equipment of this type is to be used for short-run orders (e.g. less than 100,000 units) or orders in which successive images of a run need to be different in some way. For example, in order to overprint successive images with serial numbers, expiration dates or the like, a separate overprint head must be used after the printing process to affix the overprint. This separate head causes difficultly on the production line because it is prone to miss-registration due to unintended movement of the substrate when the substrate is deposited on a conveyor following the printing operation.

Many printing processes also do not lend themselves to short-run production because any alteration of the image requires replacement and realigning of the printing plates requires a costly and time-consuming operation which is usually not economically feasible.

SUMMARY OF THE INVENTION

The present invention overcomes the above-described shortcomings of the prior art by using a plurality of inkjet heads that successively deposit inks of different consistency directly on one or more blanket rollers under the control of a computer. The image thus formed is transferred to the substrate and may then be cured by ultraviolet radiation. The method and apparatus of this invention does away with the need for printing plates, makes it possible to electronically change the image or any part thereof from one impression to the next via a computer program, and dramatically speeds up the printing process.

Similarly, variable overprint indicia can be applied as part of the image formation process, and the need for a separate overprint heading and curing station is avoided. In addition, the present invention avoids or greatly limits the problems of reduction of ink thickness (the so-called "split-the-ink" problem) and increase in size of the ink dot during successive transfers (the so-called "dot gain" problem), and avoids blurring or "ghosting" of images.

The present invention also provides an increase in image resolution when compared to conventional ink-jet printing processes. The ink droplet placed on the blanket roller has a rounded, outward extending (with respect to the center of the roller), bubble-like surface; the opposite inward side of the droplet (again with respect the center of the roller) that is in contact with the roller surface is flat. When the blanket roller transfers the droplet to the substrate, or printed material, the droplet's flat surface faces outward and is the visible portion of the droplet on the printed material, producing a sharper, higher resolution image on the printed material.

The invention also allows variable imaging via a computer program and reduces the cost associated with cleaning of the cylinders of the printing press.

These and other advantages will be readily apparent to those skilled in the art with reference to the descriptions and drawings presented herewith.

DETAILED DESCRIPTION OF THE PREFERRED EMBODIMENTS

Figure 1:
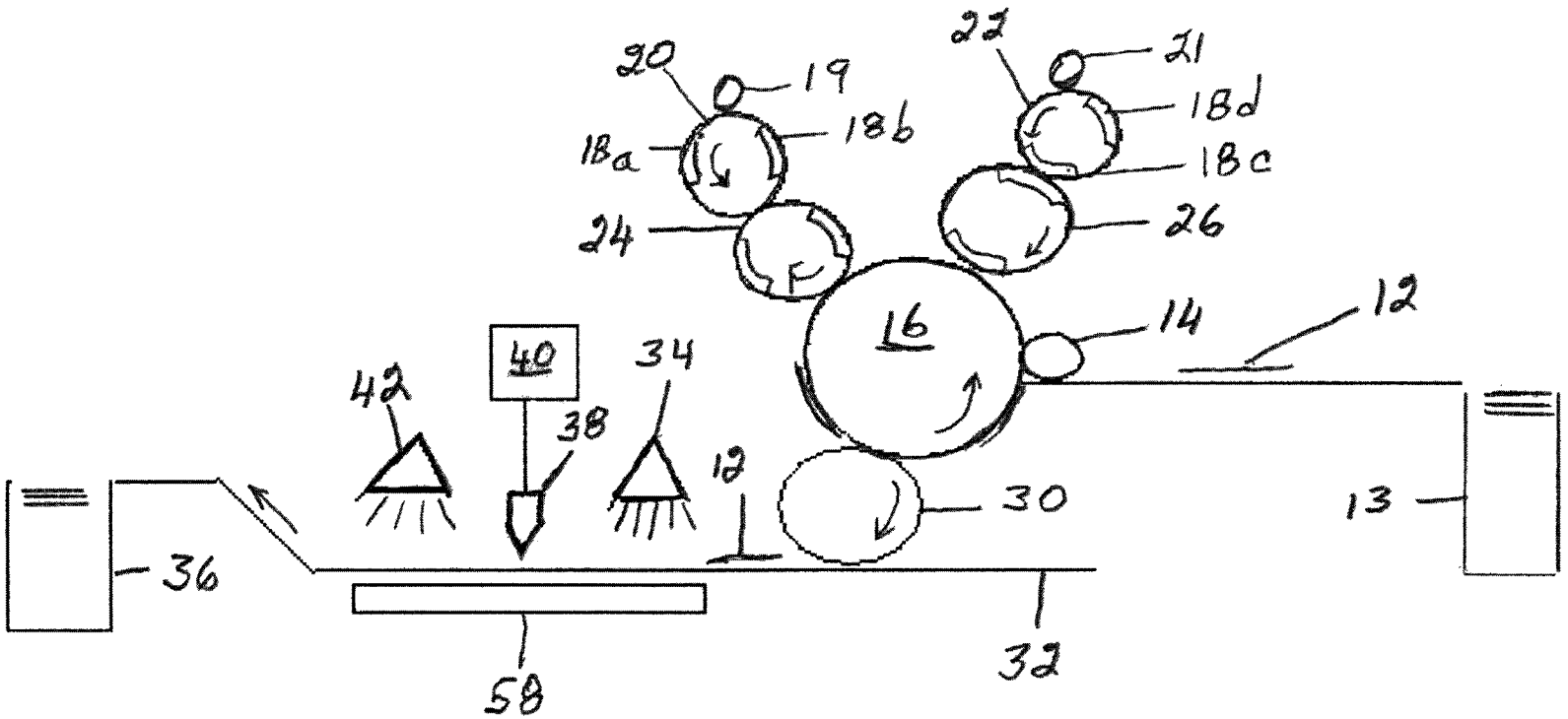
Fig. 1 Prior Art
FIG. 1 is a schematic depiction of a conventional waterless offset printing station.

A prior art offset printer is shown in FIG. 1. Sheets 12 of blank paper are withdrawn from a storage unit 13 and are individually fed to a feed roller 14. The sheets 12 are shown as individual sheets of printable material or substrate; however, the printable material may also be provided in the form of a continuous roll of printable material or fan-folded printable material, wherein individual sheets 12 may be cut, perforated or scored later in the production process. The feed roller 14 supplies the sheets 12 in precise registration against the impression cylinder 16 and are firmly held on the impression cylinder 16 by a conventional vacuum mechanism or other appropriate apparatus.

The four colors of the image are created by four inked printing plates 18*a*, 18*b* carried on plate cylinder 20 and 18*c*, 18*d* carried on plate cylinder 22. The plates 18*a* through 18*d* are coated with UV-curable ink by inking rollers 19 and 21 (shown schematically in FIG. 1). As the cylinders 20 and 22 rotate, they deposit the four one-color components of the four-color image onto their respective transfer cylinders 24, 26. As the sheets 12 make their way (twice) around the rotating impression cylinder 16, the transfer cylinders 24, 26 move in sync with the sheets 12 to successively print the four color components of the image over one another in exact registration. When the image has been fully printed, the sheet 12 is stripped away from the impression cylinder 16 by the stripping roller 30, and is deposited onto a moving web or conveyor 32 that carries it through the UV curing heads 34 and 42, using a UV target 58, to the printed storage unit 36.

It will be noted that since the printing plates 18*a* through 18*d* are physical objects that must be manually set up (at substantial time and labor costs) for accurate registration with each other, it is not cost-effective to use the above-described apparatus for short runs (e.g. less than 100,000 copies). Likewise, the prior art apparatus of FIG. 1 cannot provide sequentially numbered or otherwise variably overprinted images without a separate overprint head 38, such as a laser or inkjet printer driven by a computer 40, which may have to be associated with the second UV curing head 42.

Figure 2:
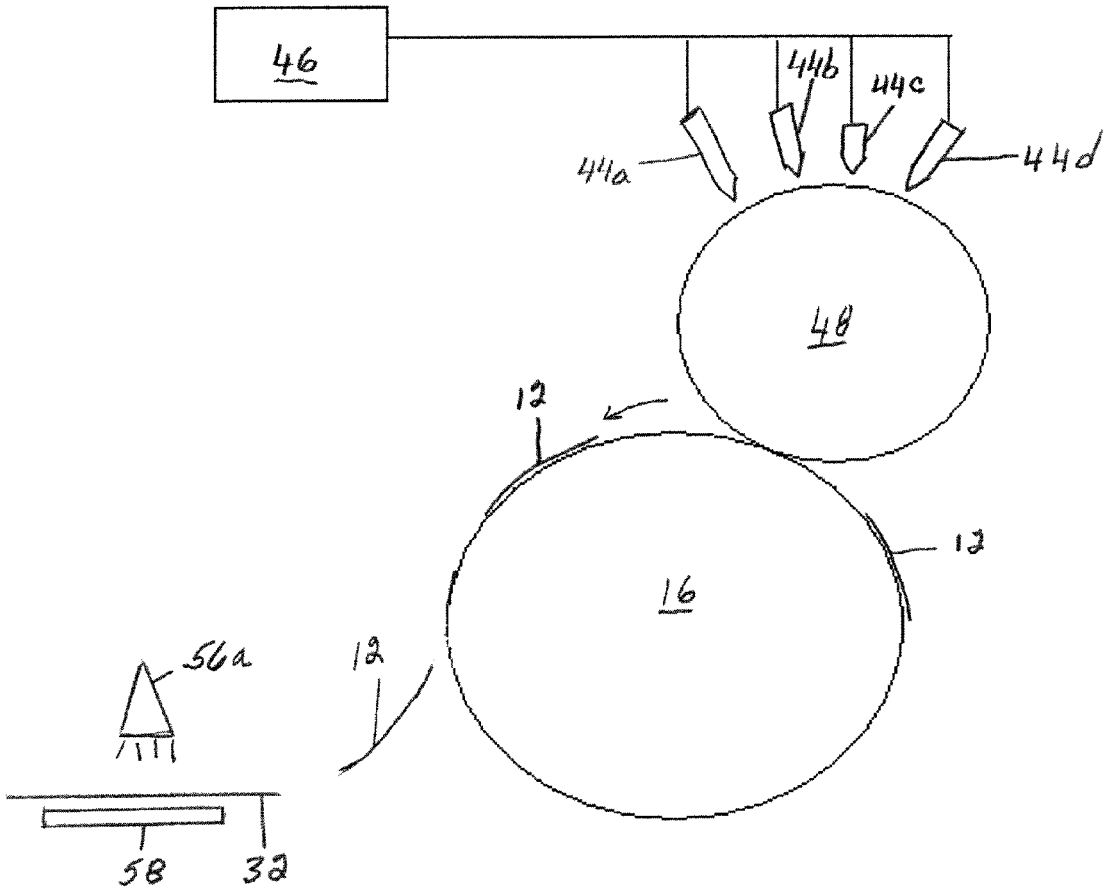
FIG. 2 is a schematic depiction of an embodiment of a printing station according to the present invention.

FIG. 2 shows an embodiment of a printing station in accordance with the invention and uses the same numbers for corresponding parts shown in FIG. 1. In FIG. 2, a set of four single-color inkjet heads 44*a* through 44*d* driven by a computer 46 is so positioned as to sequentially deposit colored ink droplets or pixels of the image that are in exact registration with each other directly onto the blanket cylinder 48. As the cylinders 48 and 16 rotate, the completed image is then transferred from the blanket cylinder 48 onto the sheet 12 carried by the impression cylinder 16. Consequently, the sheet 12 needs to make only one revolution on the impression cylinder 16 before being stripped off onto the conveyor 32. Moreover, after transfer to the sheet 12, the flat side of the droplet has reversed orientation and faces outward on the sheet 12, providing a sharper, higher resolution visible image than prior art printing.

Because the image is created separately for each sheet 12 under the control of software associated with the computer 46, sequential numbering or other variable information can be produced differently on each sheet as part of the creation of the image itself. Likewise, runs of different finished sheets, in the form of, for example, printed sheets, cards, coupons, lists or labels can be done in any length, as the change from one image run to the next requires no more than switching from one program to another in computer 46.

Once the entire image has been deposited onto the blanket cylinder 48, the rotation of the blanket cylinder 48 brings the image into contact with the sheet 12 on the impression cylinder 16. When the image has thus been printed, the sheet 12 is stripped from the impression cylinder 16 by conventional means and placed on the conveyor 32. The conveyor 32 passes the sheet underneath the UV head 56*a* (as in FIG. 2) which exposes the image to sufficient ultraviolet energy to cure the image before the sheet 12 is conveyed to the printing sheet storage unit 36.

The blanket material placed on the blanket cylinder 48 may include silicone coated polyester, silicone coated rubber, silicone coated paper, silicone-coated aluminum, or a host of other materials that can receive ink in the desired manner.

In an alternative embodiment of the invention as shown in FIG. 3, which again uses the same numbers for corresponding parts shown in FIGS. 1 and 2, a better quality of print is attained by providing two blanket cylinders 48*a* and 48*b*. Two of the four image colors are deposited onto blanket cylinder 48*a*, and the other two are deposited onto blanket cylinder 48*b*. The partially colored image from the blank cylinder 48*b* is imprinted onto the sheet 12. That partially colored image may next be cured by a UV head 56 while the sheet 12 is still on the impression cylinder 16. The other two image colors are then deposited on blanket cylinder 48*a* and, in turn, transferred to sheet 12 from blanket cylinder 48*a*. The UV head 56*a* may be positioned to direct UV light onto the sheet 12 for a final curing after the sheet 12 is stripped from the impression cylinder 16.

Figure 3:
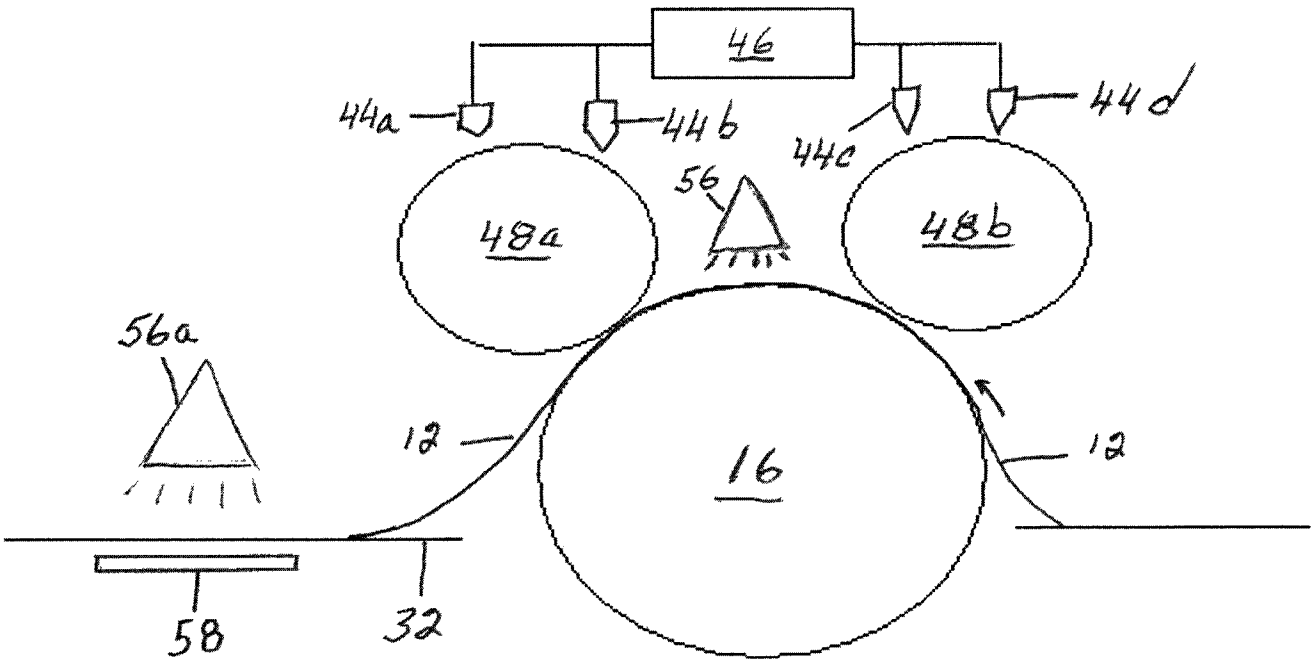
FIG. 3 is a schematic depiction of an alternative embodiment of the inventive printing station.

In another embodiment shown in FIG. 4, which again uses the same part numbers for the corresponding parts shown in FIGS. 1-3, the process is divided into four separate segments such that each of the four color images is, under control of the computer 46, deposited on a single blanket cylinder, transferred to the sheet 12 on a single corresponding impression cylinder, and cured after the transfer. Thus, inkjet 44*d* transfers one color image to sheet 12 on blanket cylinder 48*d*, after which it is cured by UV head 56*d;* inkjet 44*c* transfers a second color image to sheet 12 on blanket cylinder 48*c*, after which it is cured by UV head 56*c;* inkjet 44*b* transfers a third color image to sheet 12 on blanket cylinder 48*b*, after which it is cured by UV head 56*b;* and inkjet 44*a* transfers a fourth color image to sheet 12 on blanket cylinder 48*a*, after which it is cured by UV head 56*a* over UV target 58.

Figure 4:
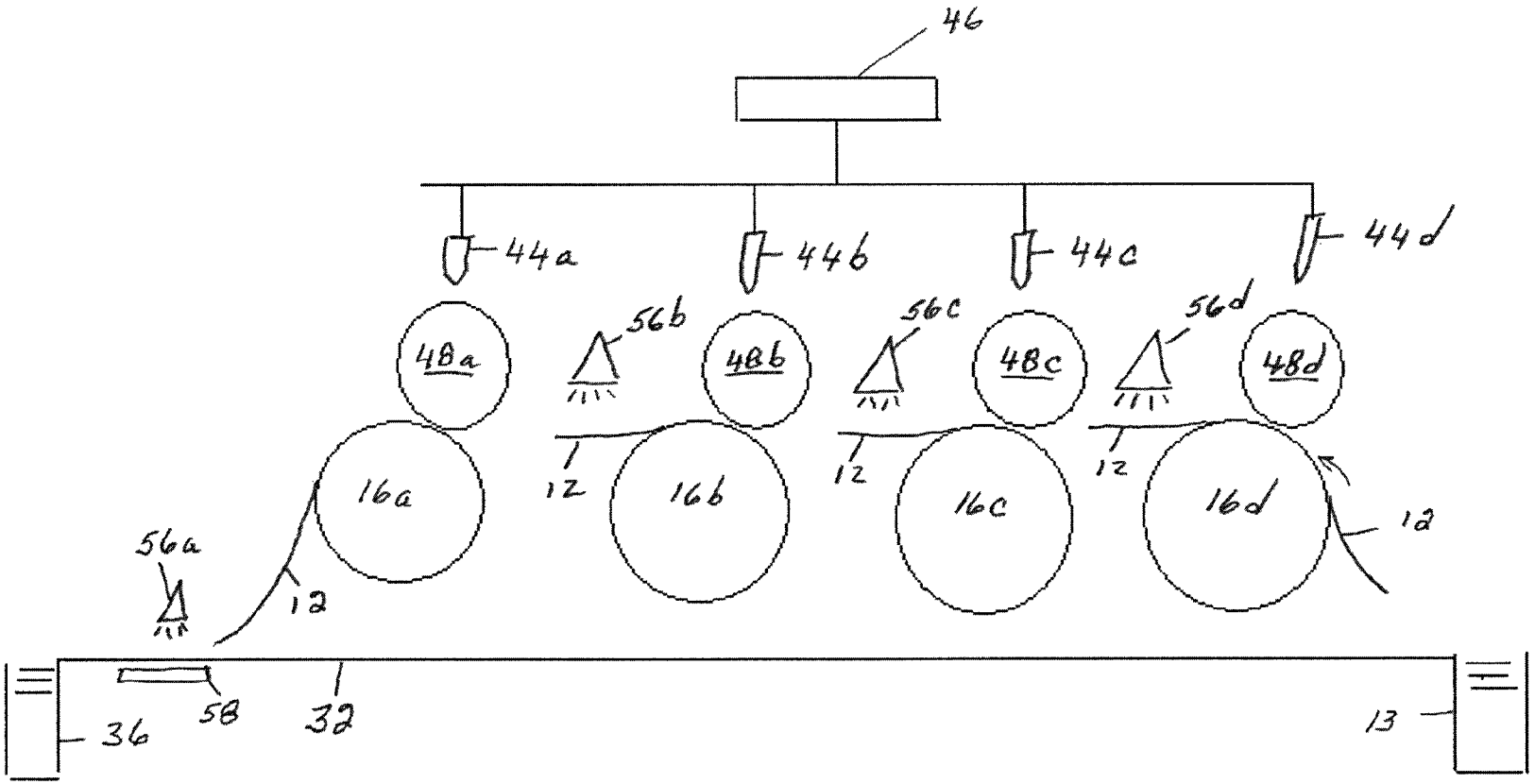
FIG. 4 is a schematic depiction of an alternative embodiment of the inventive printing station.

As will be appreciated in the system shown in FIG. 4, the selection of blankets and the flexibility of the system with respect to substrates are very substantial, as a multitude of combinations are available due to the number of blanket cylinders, the number of available blankets, and number and variable thicknesses of available substrates. Also, the system shown in FIG. 4 is a temperature controlled system, which eliminates the need for a plurality of wells as in the prior art.

In the embodiments of FIGS. 2, 3, and 4, it may be desirable to use UV-curable inks of different viscosities for the four inkjet heads 44*a* through 44*d*. Specifically, the first head, 44*d* to deposit ink onto a given spot of the blanket cylinder 48 as the cylinders rotate would use the highest viscosity one of the four colored ink formulations (yellow, magenta, green and black) used in the system. The second head 44*c* would use a slightly less viscous formulation, the third head 44*d* a still less viscous formulation, and the fourth head 44*a* the least viscous formulation of the four. The reason for this is that the deposited ink droplets mix properly only when deposited onto droplets of higher viscosity.

Because the available curing time is necessarily very short in a high-speed printing line, the UV head 56*a* in FIGS. 2, 3, and 4 must put out a considerable amount of radiant energy. This radiation generates substantial heat, and cooling of the UV target 58 is therefore conventionally required. In the embodiments disclosed in FIGS. 3 and 4, if one or more UV heads 56, 56*b*, 56*c*, or 56*d* are placed adjacent the respective impression cylinder 16 in FIG. 3 or the impression cylinders 16*b*, 16*c*, and 16*d* in FIG. 4, so that the sheet 12 is cured while on such impression cylinders, the same heating problem also arises. Thus, a cooling jacket may be provided on the inside of the impression cylinder 16 (FIG. 3) or the impression cylinders 16*b*, 16*c*, and 16*d* (FIG. 4).

The changes and alternatives described above, and others, may be made in the printing method and apparatus described herein without departing from the scope hereof. It should thus be noted that the matter contained in the above description or shown in the accompanying drawings should be interpreted as illustrative and not in a limiting sense. The following claims are intended to cover generic and specific features described herein, as well as all statements of the scope of the present method and system, which, as a matter of language, might be said to fall therebetween.

We claim:

1. A high-speed, multicolor printing system, comprising:

(a) a rotatable impression cylinder arranged to receive and hold on its surface a substrate to be printed;

(b) at least one rotatable blanket cylinder arranged to rotate opposite the impression cylinder and having a surface for receiving at least a portion of a multicolored image which transfers to the substrate as the blanket cylinder and the impression cylinder rotate; and (c) a plurality of inkjet heads under the control of a computer, the inkjet heads being positioned along a periphery of the at least one blanket cylinder, at least one of the inkjet heads being arranged to deposit one color of the multicolored ink image directly onto the blanket cylinder;

wherein:

the inkjet heads deposit inks of different viscosities; and the inkjet heads are arranged such that the inks are successively deposited on the blanket cylinder in descending order of viscosity.

2. A multicolor printing system, comprising:

(a) a rotatable impression cylinder, a surface of the impression cylinder having a first point and a second point, the impression cylinder configured to receive and hold on its surface between the first and second points a substrate for receiving ink;

(b) a first rotatable blanket cylinder adjacent the first point, the first rotatable blanket cylinder configured to rotate opposite the impression cylinder, the first rotatable blanket cylinder having a surface for receiving and transferring ink to the substrate;

(c) a second rotatable blanket cylinder adjacent the second point, the second rotatable blanket cylinder configured to rotate opposite the impression cylinder, the second rotatable blanket cylinder having a surface for receiving and transferring ink to the substrate;

(d) a computer for controlling a first, a second, a third, and a fourth inkjet head;

(e) a first ultraviolet radiation source disposed adjacent the impression cylinder between the first and second points; and (f) a second ultraviolet radiation source;

wherein:

the first and second inkjet heads are positioned along a periphery of the first blanket cylinder and are arranged to sequentially deposit a first color and a second color of ink onto the first blanket cylinder;

the third and fourth inkjet heads are positioned along a periphery of the second blanket cylinder and are arranged to sequentially deposit a third color and a fourth color of ink onto the second blanket cylinder;

ink from the first and second inkjet heads is transferred from the first blanket cylinder to the substrate between the first point and the first ultraviolet radiation source;

ink from the third and fourth inkjet heads is transferred from the second blanket cylinder to the substrate between the second point and the first ultraviolet radiation source after the ink on the substrate from the first and the second inkjet heads has been cured by the first ultraviolet radiation source;

an inside portion of the impression cylinder contains a cooling jacket to counter heat produced by the first ultraviolet radiation source;

inks of the first, second, third, and fourth colors are deposited in descending order of viscosity; and at least one of the first and second blanket cylinders comprises a silicone coated material.

3. The multicolor printing system of claim 2, wherein:

a diameter of the impression cylinder is greater than a diameter of the first blanket cylinder; and the diameter of the impression cylinder is greater than a diameter of the second blanket cylinder.

4. The multicolor printing system of claim 3, wherein the first, second, third, and fourth inkjet heads respectively deposit inks that are yellow, magenta, green and black in color.

5. The multicolor printing system of claim 4 wherein the first and second blanket cylinders comprise a silicone coated material.

6. The multicolor printing system of claim 5 wherein the material is one of polyester, rubber and aluminum.

7. The multicolor printing system of claim 6, further comprising means for stripping the substrate from the impression cylinder; and wherein the substrate is stripped from the impression cylinder before curing is effectuated by the second ultraviolet radiation source.

8. A multicolor printing system, comprising:

(a) a rotatable impression cylinder, a surface of the impression cylinder having a first point and a second point, the impression cylinder configured to receive and hold on its surface between the first and second points a substrate for receiving ink;

(b) a first rotatable blanket cylinder adjacent the first point, the first rotatable blanket cylinder configured to rotate opposite the impression cylinder, the first rotatable blanket cylinder having a surface for receiving and transferring ink to the substrate;

(c) a second rotatable blanket cylinder adjacent the second point, the second rotatable blanket cylinder configured to rotate opposite the impression cylinder, the second rotatable blanket cylinder having a surface for receiving and transferring ink to the substrate;

(d) a computer for controlling a first, a second, a third, and a fourth inkjet head;

(e) a first ultraviolet radiation source disposed adjacent the impression cylinder between the first and second points; and (f) a second ultraviolet radiation source;

wherein:

the first and second inkjet heads are positioned along a periphery of the first blanket cylinder and are arranged to sequentially deposit a first color and a second color of ink onto the first blanket cylinder;

the third and fourth inkjet heads are positioned along a periphery of the second blanket cylinder and are arranged to sequentially deposit a third color and a fourth color of ink onto the second blanket cylinder;

ink from the first and second inkjet heads is transferred from the first blanket cylinder to the substrate between the first point and the first ultraviolet radiation source;

ink from the third and fourth inkjet heads is transferred from the second blanket cylinder to the substrate between the second point and the first ultraviolet radiation source after the ink on the substrate from the first and the second inkjet heads has been cured by the first ultraviolet radiation source;

an inside portion of the impression cylinder contains a cooling jacket to counter heat produced by the first ultraviolet radiation source; and inks of the first, second, third, and fourth colors are deposited in descending order of viscosity.

* * * * *